US007832237B2

(12) United States Patent
Chang et al.

(10) Patent No.: US 7,832,237 B2
(45) Date of Patent: Nov. 16, 2010

(54) MULTIPLE DIRECTIONAL CLUTCH FOR A WASHING MACHINE

(75) Inventors: Eric E. Chang, Saint Joseph, MI (US); William K. Kangas, Buchanan, MI (US); Kurt Werner, Saint Joseph, MI (US); Scott D. Slabbekoorn, Saint Joseph, MI (US); James R. Sawyer, Monticello, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/424,959

(22) Filed: Apr. 16, 2009

(65) Prior Publication Data

US 2009/0193854 A1 Aug. 6, 2009

Related U.S. Application Data

(62) Division of application No. 11/174,779, filed on Jul. 5, 2005, now Pat. No. 7,614,262.

(51) Int. Cl.
*D06F 37/40* (2006.01)

(52) U.S. Cl. ..... 68/12.24; 68/12.23; 68/23.6; 68/23.7

(58) Field of Classification Search ..... 68/12.24, 68/23.6, 23.7, 12.23
See application file for complete search history.

(56) References Cited

U.S. PATENT DOCUMENTS 1,975,234 A * 10/1934 Lockett ..... 192/142 R
4,283,928 A * 8/1981 Stone ..... 68/23.7
4,317,343 A * 3/1982 Gerry ..... 68/23.7
4,371,067 A * 2/1983 Gerry ..... 192/93 A
4,390,826 A * 6/1983 Erdman et al. ..... 318/400.17
4,474,038 A * 10/1984 McMillan ..... 68/23 R
4,953,369 A * 9/1990 Ito ..... 68/23.7
5,460,018 A * 10/1995 Werner et al. ..... 68/23.6
2003/0034054 A1 2/2003 Lee et al.

FOREIGN PATENT DOCUMENTS

BR 0204385 A 6/2004
CL 2086-98 8/1998
WO 2007000034 A1 1/2007

* cited by examiner

*Primary Examiner*—Joseph L Perrin
*Assistant Examiner*—Benjamin Osterhout
(74) *Attorney, Agent, or Firm*—Clifton G. Green; McGarry Bair P.C.

(57) ABSTRACT

An automatic washing machine comprises a spin tube coupled to the basket and an agitator shaft coupled to an agitator mounted in the basket. A motor coupled to the agitator shaft applies a torque the agitator shaft and thereby the agitator in first and second torque directions. A clutch couples the spin tube to the agitator shaft for cooperative rotation of the basket and the agitator regardless of the rotational direction of the agitator shaft. Because of the dual directionality of the clutch, reversing the motor simultaneously dynamically brakes the basket and the agitator, thereby eliminating the need for a separate friction brake for the basket.

10 Claims, 12 Drawing Sheets

MULTIPLE DIRECTIONAL CLUTCH FOR A WASHING MACHINE

CROSS-REFERENCE TO RELATED APPLICATION(S)

This application is a divisional of U.S. patent application Ser. No. 11/174,779, filed Jul. 5, 2005, now U.S. Pat. No. 7,614,262, issued Nov. 10, 2009, which is incorporated herein by reference in its entirety.

BACKGROUND OF THE INVENTION

1. Field of the Invention

The invention relates generally to a multiple directional clutch for a vertical axis washing machine and more specifically to a multiple directional wrap spring clutch that enables dynamic breaking of a washing machine basket.

2. Description of the Related Art

Vertical axis washing machines typically comprise an agitator, impeller, or other clothes and/or wash liquid moving element mounted for rotation inside a perforated basket, which defines a wash chamber for holding a clothes load and is rotationally mounted inside a stationary wash tub. During a wash cycle, the clothes load is usually subjected to a wash step to wash the clothes load with wash liquid, a rinse step to rinse the wash liquid from the clothes load with water, and a spin step to extract excess rinse water from the clothes load. During the wash and rinse steps, the agitator rotates relative to the basket to move the clothes load and/or liquid within the wash chamber. During the spin step, both the agitator and the basket typically rotate at high speeds in the same direction to plaster the clothes load against the peripheral wall of the basket and thereby extract excess water from the items in the clothes load.

Rotation of the agitator and the basket is driven by a motor located in the washing machine beneath the wash tub. The agitator is fixedly mounted to an upper end of an agitator shaft that extends through the bottom of the basket, and the lower end of the agitator shaft is coupled to the motor such that the motor applies torque to the agitator shaft to induce rotation of the agitator shaft and thereby the agitator. Usually, the motor is reversible to reverse the rotational direction of the agitator according to stage of the wash cycle. Additionally, the motor dynamically brakes the agitator by reversing the torque applied to the agitator from its current rotational direction.

The basket is fixedly attached to a spin tube that surrounds the agitator shaft with upper and lower bushings therebetween. The spin tube is selectively mechanically coupled to the agitator shaft via a unidirectional clutch mechanism. When the clutch mechanism mechanically couples the spin tube to the agitator shaft, the spin tube rotates with the agitator shaft so both the basket and the agitator rotate together. Conversely, when the clutch mechanism mechanically decouples the spin tube from the agitator shaft, the agitator rotates alone while the basket remains stationary. To cease rotation of the spin tube and thereby the basket, the washing machine includes a separate mechanical brake mechanism that engages the spin tube or other component coupled to the basket when commanded to do so by a controller.

Numerous types of clutch mechanisms have been developed to accomplish transmission of rotational energy from the agitator shaft to the spin tube. One type of well-known clutch mechanism is a wrap spring clutch. Typically, a wrap spring clutch is a torsion spring disposed around the outer diameter of the spin tube and a coupler integrally formed with or otherwise fixed to the agitator shaft and axially aligned with the spin tube. Commonly, the wrap spring is wrapped around spin tube and the coupler so that in its neutral state, it is in a tightened condition around the spin tube and coupler so that it naturally mechanically couples the spin tube to the agitator shaft. When the motor/agitator shaft rotates in a first direction, the wrap spring further tightens from the neutral state to continue to couple the spin tube to the agitator shaft/coupler. Conversely, the wrap spring inherently unwinds or loosens about the spin tube and coupler when the motor reverses the torque applied to the agitator shaft, thereby resulting in the wrap spring slipping relative to the spin tube and coupler and thereby decoupling the spin tube from the agitator shaft/coupler. Thus, this type of wrap spring clutch is unidirectional as the wrap spring couples the agitator shaft and the spin tube only during rotation in one direction. Rotation of the basket is limited to rotation in only one direction, the direction that corresponds to the engagement of the clutch. Thus, it follows that when the motor is reversed to reverse the torque on the agitator shaft and brake the agitator, the wrap spring decouples the spin tube from the agitator shaft, and the spin tube and thereby the basket continue to rotate. Consequently, a separate brake that acts upon the spin tube or other component coupled to the basket is required to cease rotation of the basket. It is therefore desirable have a clutch that eliminates the need for a separate brake by coupling the motor and basket during rotation in both forward and reverse directions so that reversal of the motor brakes the basket.

SUMMARY OF THE INVENTION

A method according to one embodiment of the invention for dynamically braking a basket of an automatic washing machine comprising a spin tube coupled to the basket and an agitator shaft coupled to an agitator mounted in the basket comprises coupling the spin tube to the agitator shaft for cooperative rotation, applying a torque to the agitator shaft in a first torque direction to rotate the agitator shaft and thereby rotate the agitator and the basket, and maintaining the coupling of the spin tube and the agitator shaft while applying a torque to the agitator shaft in a second torque direction opposite the first torque direction to dynamically brake the agitator and the basket.

The applying of the torque to the agitator shaft in the first torque direction can comprise spinning the agitator shaft at a speed sufficient to extract liquid from the clothes load. The method can further comprise decoupling the spin tube from the agitator and reciprocally rotating the agitator shaft between the first and second rotation directions prior to the spinning of the agitator shaft. The method can further comprise ceasing rotation of the agitator shaft to stop the reciprocal rotation of the agitator shaft prior to the spinning of the agitator shaft.

The applying of the torque to the agitator shaft in the first torque direction can comprise driving a motor coupled to the agitator shaft. The applying of the torque to the agitator shaft in the second torque direction can comprise reversing the motor.

The coupling of the spin tube to the agitator shaft can comprise actuating a multi-directional clutch to couple the spin tube to the agitator shaft. The actuating of the multi-directional clutch can occur as a result of the applying of the torque to the agitator shaft in the first torque direction. The maintaining of the coupling of the spin tube and the agitator can comprise actuating the multi-directional clutch again to maintain the coupling of the spin tube to the agitator shaft. The actuating of the multi-directional clutch again can occur as a result of the applying of the torque to the agitator shaft in the second torque direction to dynamically brake the agitator and the basket. The actuating of the multi-directional clutch and the actuating of the multi-directional clutch again can comprise tightening a portion of a wrap spring that surrounds the agitator shaft and the spin tube. The method can further comprise decoupling the spin tube from the agitator and reciprocally rotating the agitator shaft between first and second rotation directions. The decoupling of the spin tube from the agitator shaft can comprise deactivating the multi-directional clutch to decouple the spin tube from the agitator shaft. The deactivating of the multi-directional clutch can comprise loosening the wrap spring.

The maintaining the coupling of the spin tube and the agitator shaft can occur as a result of the applying of the torque to the agitator shaft in the second torque direction.

An automatic washing machine according to another embodiment of the invention comprises a basket defining a wash chamber to hold a clothes load, a spin tube coupled to the basket for cooperative rotation with the basket, an agitator mounted for rotation within the basket, an agitator shaft coupled to the agitator for cooperative rotation with the agitator, a motor coupled to the agitator shaft for rotating the agitator shaft and the agitator in a first rotational direction and a second rotational direction opposite the first direction, and a clutch having a clutched condition wherein the spin tube is coupled to the agitator shaft for cooperative rotation regardless of the rotational direction of the agitator shaft.

The clutch can be operable between the clutched condition and an unclutched condition wherein the spin tube is not coupled to the agitator shaft. According to one embodiment, when the clutch is in the unclutched condition, the spin tube is not coupled to the agitator shaft regardless of the rotational direction of the agitator shaft.

The clutch can comprise a wrap spring surrounding at least a portion of the spin tube and at least a portion of the agitator shaft in a tightened condition when the clutch is in the clutched condition and in a loosened state when the clutch is in the unclutched condition. The wrap spring can surround an agitator shaft coupler on the agitator shaft. The automatic washing machine can further comprise a wrap spring housing that supports the wrap spring around the spin tube and the agitator shaft. The wrap spring can comprise a first end and a second end, and the wrap spring housing can comprise a retainer that holds the first end of the wrap spring and a slot that slidingly receives the second end of the wrap spring. The automatic washing machine can further comprise a clutch actuator with a retainer that holds the second end of the wrap spring slidingly received in the slot such that movement of the clutch actuator relative to the wrap spring housing moves the second end of the wrap spring within the slot to move the wrap spring between the tightened condition and the loosened state. The clutch actuator can comprise a cogwheel surrounding the wrap spring housing and having an inner diameter surface in which the retainer is formed and an outer diameter surface with cogs sized to receive an arm that moves the cogwheel relative to the wrap spring housing. The wrap spring housing can be fixed to the spin tube for cooperative rotation and can couple with the agitator shaft via the wrap spring when the clutch is in the clutched condition.

An automatic washing machine according to another embodiment of the invention comprises a basket defining a wash chamber to hold a clothes load, a spin tube coupled to the basket for cooperative rotation with the basket, an agitator mounted for rotation within the basket, an agitator shaft coupled to the agitator for cooperative rotation with the agitator, and a dynamic brake coupled to the spin tube to stop the rotation of the basket.

The dynamic brake can stop rotation of the basket regardless of a rotational direction of the basket.

The dynamic brake can comprise a motor coupled to the spin tube and operable between opposite torque directions, wherein the motor reverses its torque direction from one of the opposite torque directions to the other of the opposite torque directions to stop the rotation of the basket. The dynamic brake can further comprise a clutch having a clutched condition wherein the motor is coupled to the spin tube to rotate the basket. The clutch can couple the motor to the spin tube regardless of the torque direction of the motor.

The clutch can comprise a wrap spring that surrounds the spin tube and is coupled to the motor. The clutch can further comprise a wrap spring housing that supports the wrap spring and is fixedly coupled to the spin tube. The wrap spring can tightly surround one of the spin tube and a portion of the wrap spring housing to couple the motor to the spin tube during operation of the motor in the other of the opposite torque directions to stop the rotation of the basket.

The agitator shaft can be coupled to the motor for cooperative rotation with the motor, and the agitator shaft couples the motor to the clutch assembly. The clutch can further comprise an agitator shaft coupler coupled to the agitator shaft, and the wrap spring can tightly surround the agitator shaft coupler to couple the wrap spring to the motor.

DESCRIPTION OF THE PREFERRED EMBODIMENTS

Figure 1:
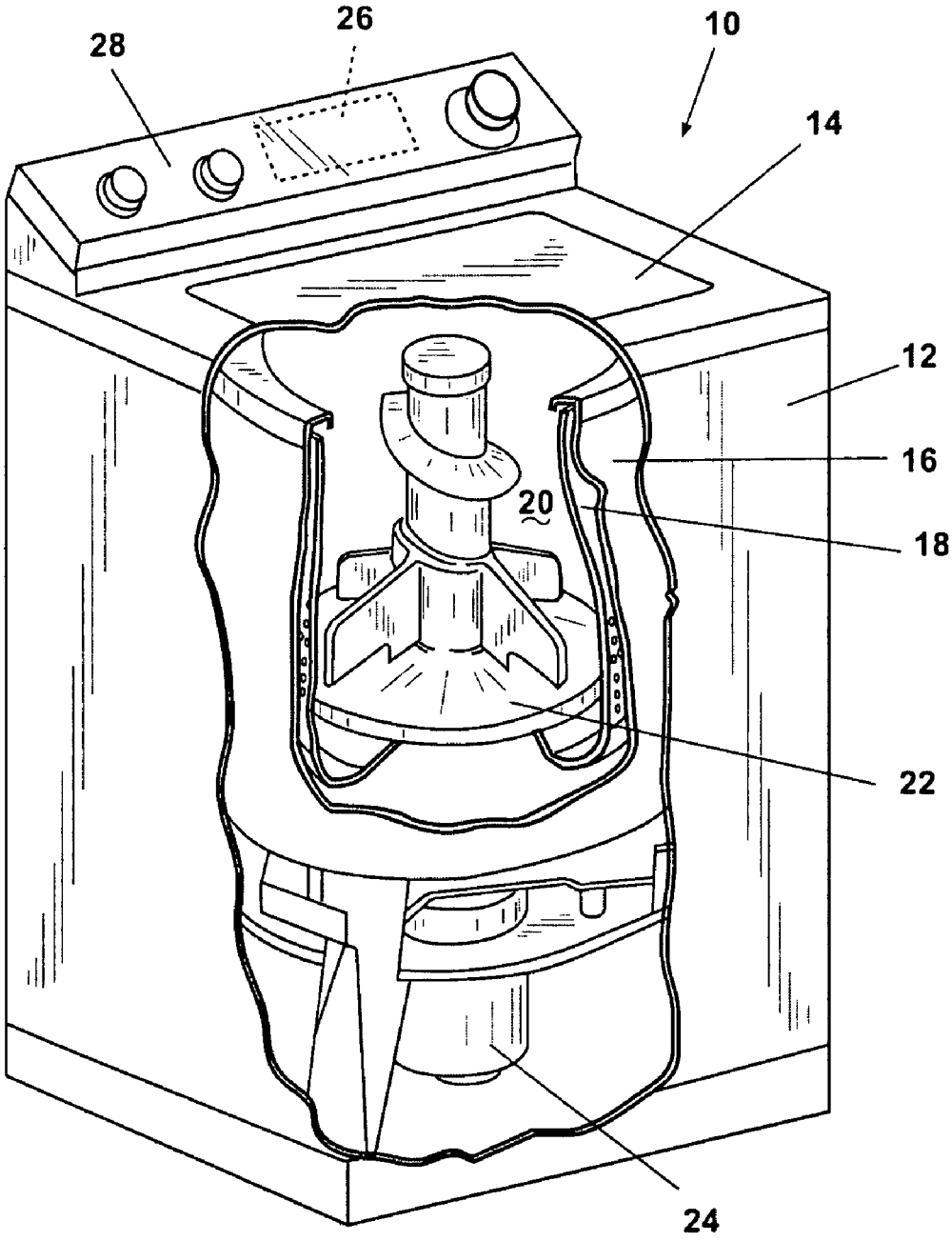
FIG. 1 is a perspective view of an exemplary conventional vertical axis washing machine with a portion of a cabinet, a wash tub, and a basket cut away to illustrate interior components thereof.

Referring now to the figures, FIG. 1 illustrates an exemplary vertical axis washing machine 10 comprising an open top cabinet 12 closed by a hinged lid 14. The cabinet 12 houses a stationary, imperforate, open top wash tub 16. A perforated, open top basket 18 rotatably mounted inside the wash tub 16 defines a wash chamber 20 having an agitator 22 or other type of clothes load and/or wash liquid mover rotatably mounted therein, as is well known in the washing machine art. Movement of the agitator 22 and the basket 18 is driven by a motor 24 disposed within the cabinet 12 below the wash tub 16 and operably coupled to a controller 26. The controller 26 communicates with a control panel 28 through which a user selects a desired manual or automatic wash cycle.

As discussed briefly in the background section, a typical wash cycle comprises at least a wash step to wash the clothes load with wash liquid, a rinse step to rinse the wash liquid from the clothes load with water, and a spin step to extract excess rinse water from the clothes load. During the wash and rinse steps, the agitator 22 rotates relative to the basket 18 to move the clothes load and/or liquid within the wash chamber 20. During the spin step, both the agitator 22 and the basket 18 typically rotate at high speeds in the same direction to extract excess water from the fabric items. Depending on the type of wash cycle selected by a user through the control panel 28, the clothes load can be subjected to a variety of combinations and numbers of wash, rinse, and spin steps.

Figure 2:
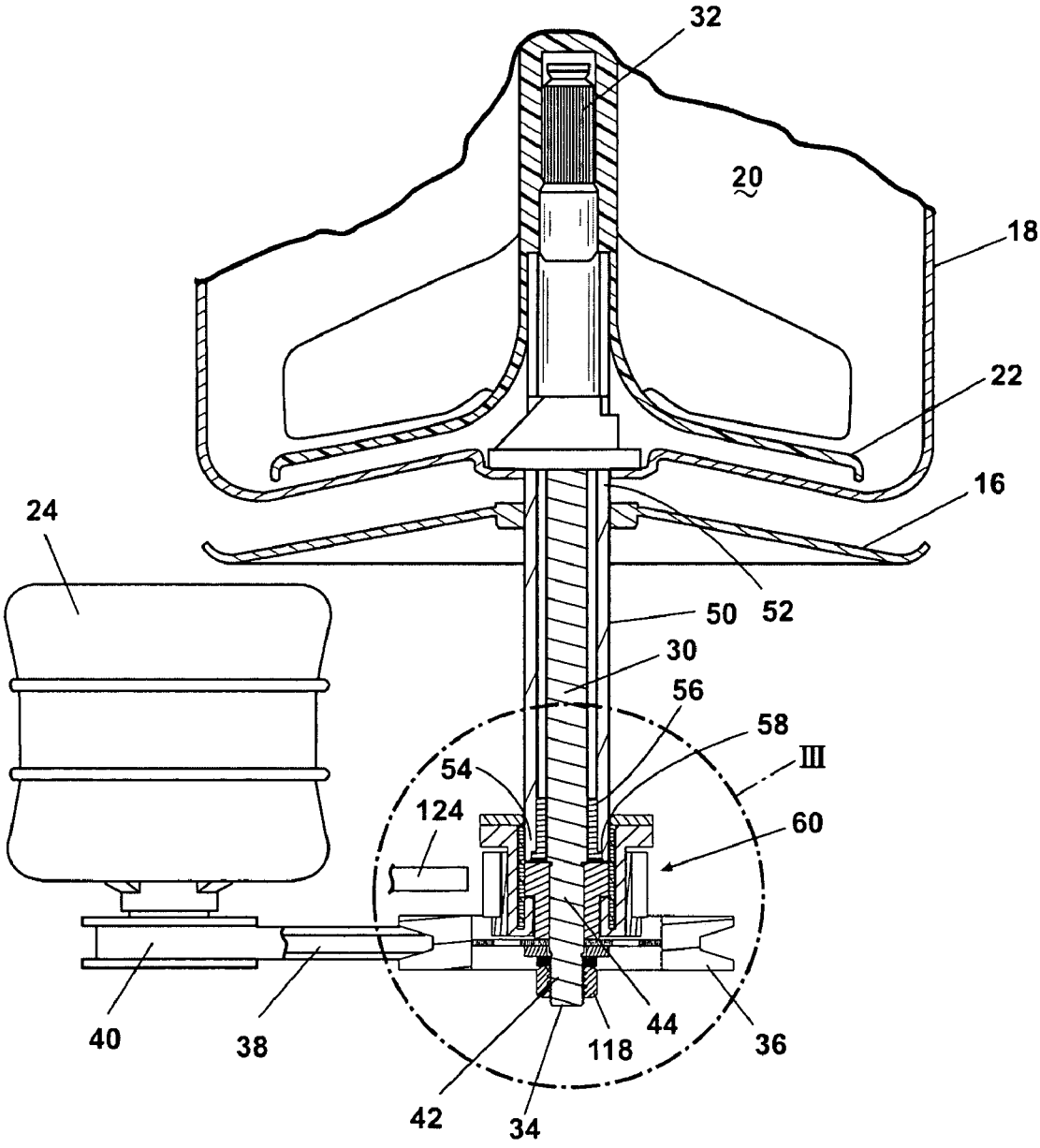
FIG. 2 is a partial sectional view of the wash tub, the basket, a motor, and a multiple directional clutch assembly according to one embodiment of the invention for a vertical axis washing machine, such as the washing machine of FIG. 1.

Referring now to FIG. 2, the motor 24 is coupled to the agitator 22 through an agitator shaft 30 having an upper end fixedly mounted to the agitator 22 and a lower end 34 mounted to a pulley 36 driven by a belt 38 that rotates around a drive wheel 40 affixed to a reversibly rotatable motor shaft (not shown), as is well known in the washing machine art. At the lower end 34, the agitator shaft 30 according to one embodiment of the invention terminates in a threaded section 42 and includes a splined section 44 above the threaded section 42. The threaded section 42 and the splined section 44 have a diameter slightly less than the portion of the agitator shaft 30 above the splined section 44.

A generally hollow spin tube 50 according to the illustrated embodiment of the invention surrounds the agitator shaft 30 with an upper bushing (not shown) and a lower bushing 56 therebetween at an upper end 52 and a lower end 54, respectively, of the spin tube 50 so that the agitator shaft 30 can rotate relative to the spin tube 50. At the upper end 52, the spin tube 50 is fixedly mounted to the basket 18 so that rotation of the spin tube 50 rotates the basket 18 in the same direction, as is well known in the washing machine art. At the lower end 54, the spin tube 50 includes an annular recess 58 formed therein to accommodate the lower bushing 56. The spin tube 50 is selectively coupled to the agitator shaft 30 for cooperative rotation by a clutch assembly 60.

Figure 3:
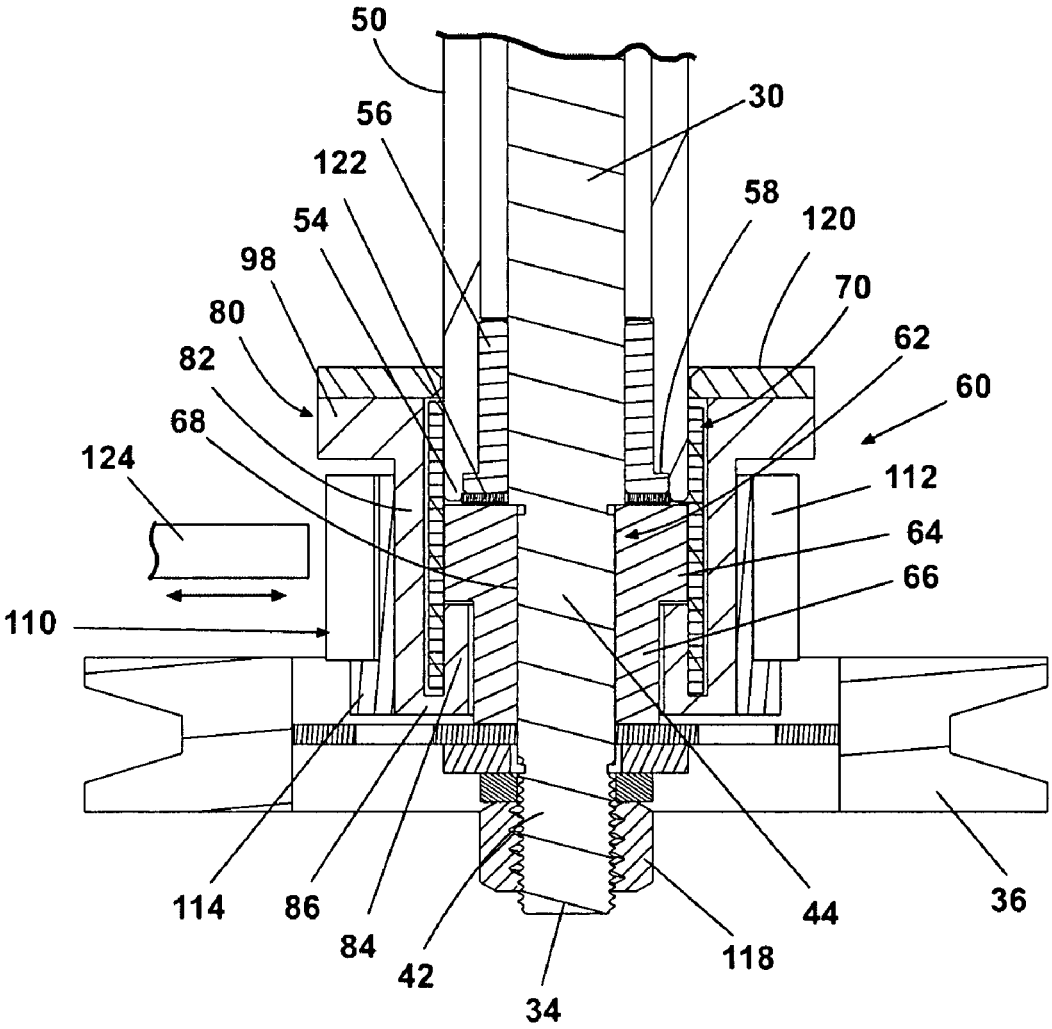
FIG. 3 is an enlarged view of the region marked III of FIG. 2.
Figure 4:
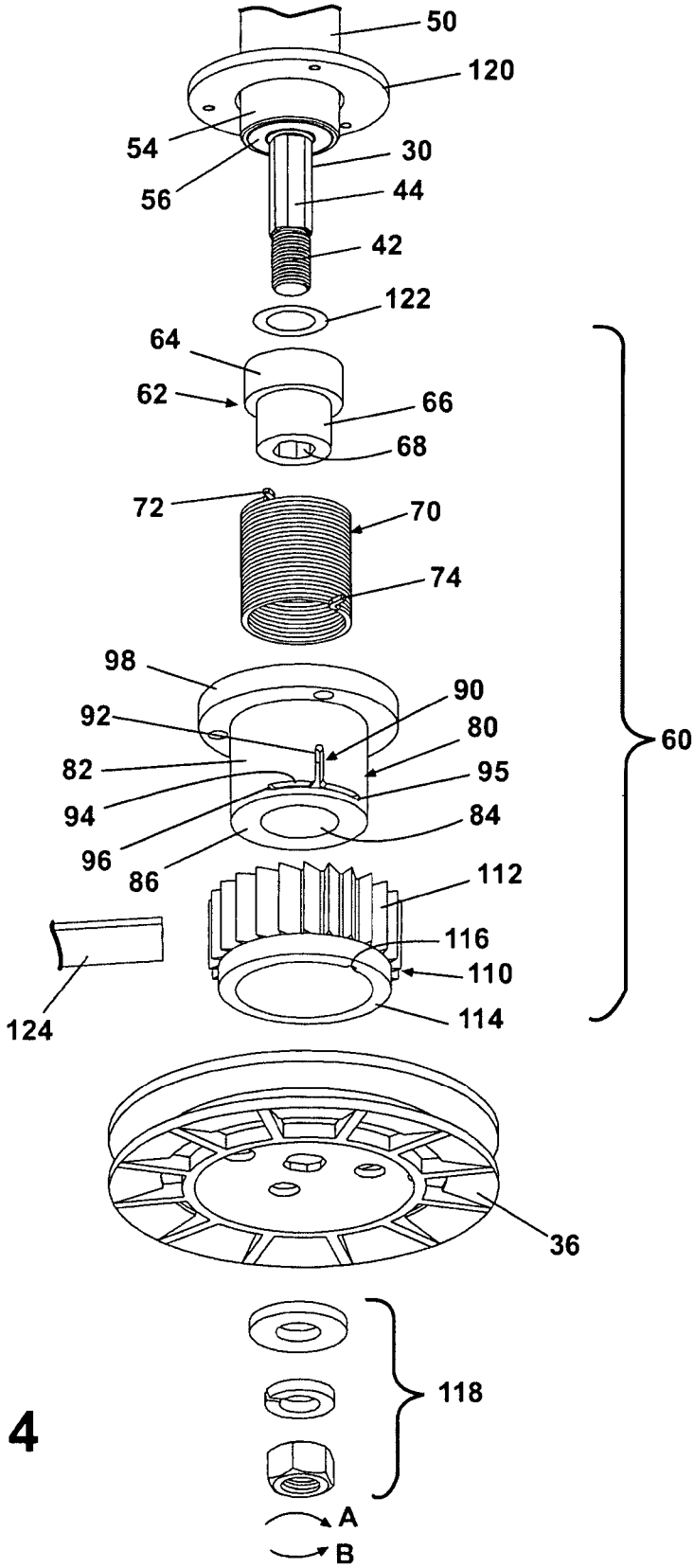
FIG. 4 is a bottom exploded view of the clutch assembly of FIG. 2.

As shown in section in FIG. 3, which is an enlarged view of the region labeled III of FIG. 2, and in perspective in FIG. 4, the clutch assembly 60 according to one embodiment of the invention comprises an agitator shaft coupler 62 formed by an upper cylindrical section 64 and a lower cylindrical section 66 having a smaller outer diameter than the upper cylindrical section 64. Further, the agitator shaft coupler 62 has a longitudinal internal splined surface 68 extending through the upper and lower cylindrical sections 64, 66 and sized and shaped to mate with the splined section 44 of the agitator shaft 30.

With continued reference to FIGS. 3 and 4, the clutch assembly 60 further comprises a clutch in the form of a wrap spring 70. According to the illustrated embodiment of the invention, the wrap spring 70 is a torsion spring made of a metal and having a generally rectangular cross-section. Additionally, the wrap spring 70 terminates in an upper, outturned tab 72 and a lower, outturned tab 74. When the wrap spring 70 shown in the figures is in a neutral state, the upper and lower tabs 72, 74 are circumferentially spaced from one another. When at least one of the upper and lower tabs 72, 74 is displaced relative to the other, the wrap spring 70 stores potential energy as the wrap spring 70 goes from the neutral state to either a tightened state or a loosened state. When the wrap spring 70 is wound along the winding direction of the wrap spring 70, the wrap spring 74 is in the tightened state, and the wrap spring 70 goes to the loosened state when the wrap spring 70 is unwound.

The wrap spring 70 is held within a wrap spring housing 80 comprising a cylindrical outer wall 82 and a coaxial cylindrical inner wall 84 joined by an annular bottom wall 86. As best viewed in FIG. 3, the inner wall 84 is spaced from the outer wall 82 a radial distance sufficient to receive the wrap spring 70, and the inner wall 84 has a height less than that of the outer wall 82. In the illustrated embodiment, the height of the inner wall 84 is about one-third the height of the outer wall 82. Further, the inner wall 84 has an inner diameter sized to receive the lower cylindrical section 66 of the agitator shaft coupler 62, as described in more detail below. The outer wall 82 includes a generally T-shaped slot 90 formed therein near the bottom wall 86 and having a vertical branch 92 bisecting a horizontal branch 94 that extends between a first stop 96 and a second stop 95. The outer wall 82 terminates at an upper end thereof in an outwardly extending flange 98 having, as best seen in FIG. 5, a retainer in the form of a notch 100 sized to hold the upper tab 72 of the wrap spring 70.

Referring back to FIGS. 3 and 4, the clutch assembly 60 further comprises a clutch actuator in the form of a cogwheel 110 having a plurality of generally identical, equally spaced, outwardly projecting teeth 112 that extend from an upper end of the cogwheel 110 to a generally smooth cylindrical base 114 at a lower end of the cogwheel 110. The teeth 112 are selectively engagable by an arm 124 that extends toward and is movable relative to cogwheel 110, as indicated by a double-headed arrow in FIG. 3. Referring additionally to FIGS. 5 and 5A, the cogwheel 110 further includes a retainer in the form of a longitudinal groove 116 formed on an inner surface thereof and sized to receive the lower tab 74 of the wrap spring 70.

When the clutch assembly 60 is assembled to the agitator shaft 30 and the spin tube 50, as shown in FIG. 3, the agitator shaft 30 is mounted within the agitator shaft coupler 62 with the splined section 44 mating with the internal splined surface 68. The lower end 34 of the agitator shaft 30 below the agitator shaft coupler 62 extends through the pulley 36, and the pulley 36 is secured to the agitator shaft 30 between the agitator shaft coupler 62 and a nut assembly 118 mounted to the threaded section 42. Thus, rotation of the pulley 36 in turn rotates the agitator shaft 30 and the agitator shaft coupler 62.

Figure 5:
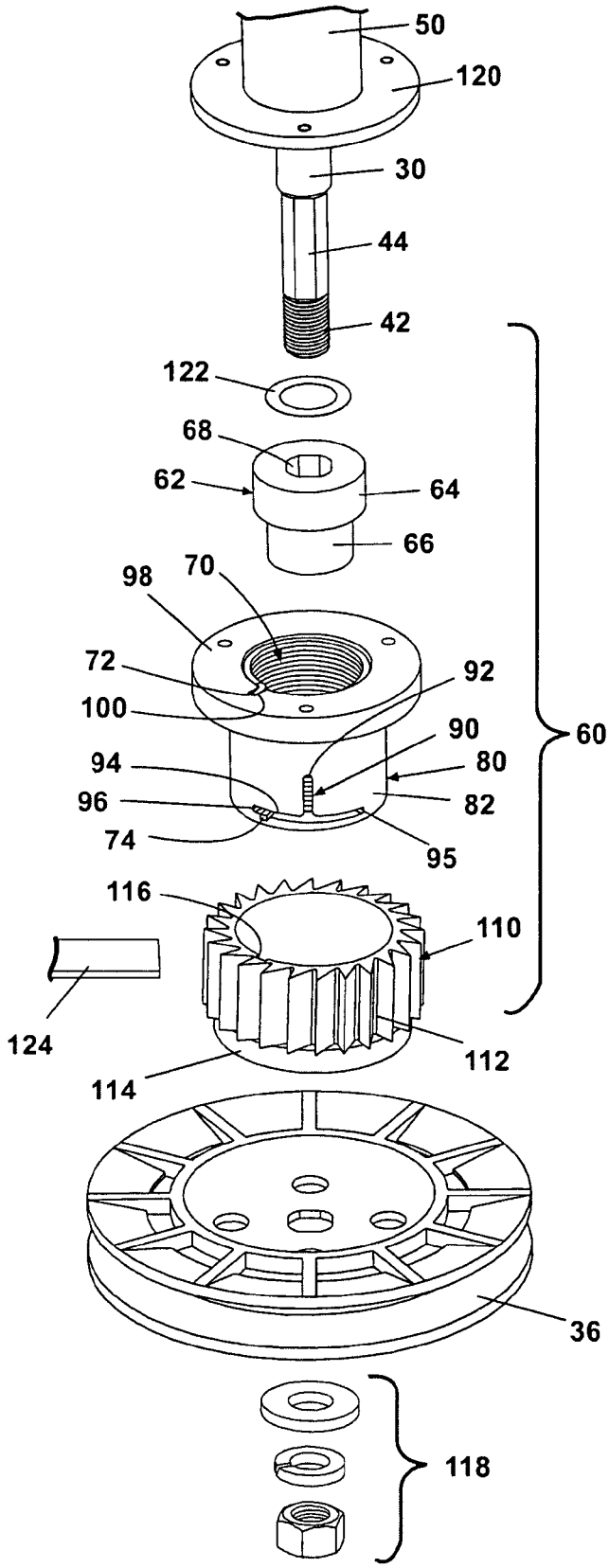
FIG. 5 is an upper exploded view of the clutch assembly of FIG. 2, with a wrap spring of the clutch assembly according to one embodiment of the invention shown assembled in a wrap spring housing and the clutch assembly shown in a clutched condition.
Figure 5A:
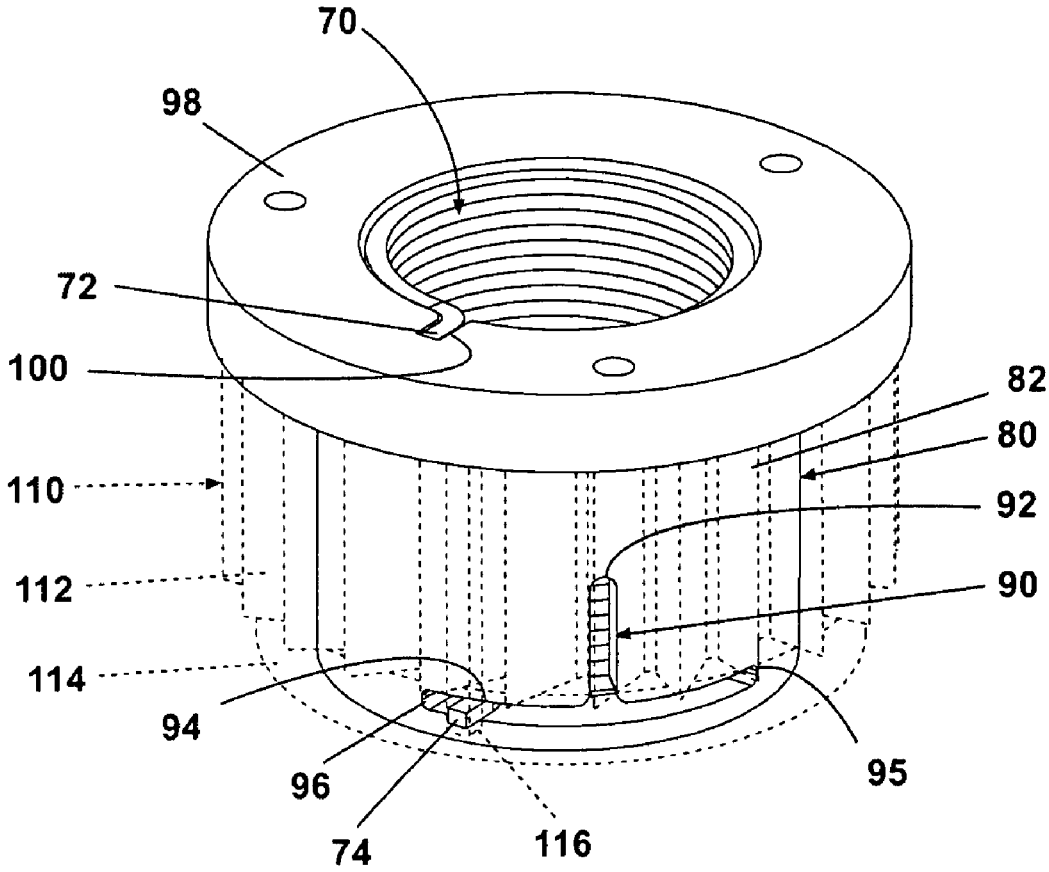
FIG. 5A is a perspective view of the wrap spring and the wrap spring housing of FIG. 5 assembled with a clutch actuator, which is shown in phantom.

The wrap spring 70 sits between the outer and inner walls 82, 84 of the wrap spring housing 80 with the upper tab 72 residing in the notch 100 and the lower tab 74 situated in the horizontal branch 94 of the slot 90, as best seen in FIG. 5. The vertical branch 92 of the slot 90 facilitates insertion of the lower tab 74 into the slot 90. The lower tab 74 extends radially through the slot 90 for receipt within the groove 116 of the cogwheel 110, which surrounds the outer wall 82 of the wrap spring housing 80. The cogwheel 110 is mounted for rotation with the wrap spring housing 80 yet can also rotate relative to the wrap spring housing 80 to displace the lower tab 74 of the wrap spring 70. Consequently, the upper tab 72 is held stationary in the notch 100, while the lower tab 74 can move within the horizontal branch 94 by rotation of the cogwheel 110 relative to the wrap spring housing 80.

Referring back to FIG. 3, the wrap spring housing 70 surrounds the agitator shaft 30, in particular the agitator shaft coupler 62, and the spin tube 50. The lower cylindrical section 66 of the agitator shaft coupler 62 is positioned between the inner wall 84 of the wrap spring housing 80 and the agitator shaft 30, and the upper cylindrical section 64 extends outward above and in axial alignment with the inner wall 84 to form an essentially continuous circumferential surface with the inner wall 84. The continuous circumferential surface extends to the spin tube 50, which resides above the agitator shaft coupler 62 with a gasket 122 positioned between the agitator shaft coupler 62 and the lower bushing 56 that resides between the lower end 54 of the spin tube 50 and the portion of the agitator shaft 30 above the splined section 44. The wrap spring 70 surrounds the continuous circumferential surface formed by the inner wall 84 of the wrap spring housing 80, the upper cylindrical section 64 of the agitator shaft coupler 62, and the lower end 54 of the spin tube 50. According to the illustrated embodiment of the invention, the inner wall 84, the upper cylindrical section 64, and the spin tube 50 comprise an equal outer diameter to form the continuous circumferential surface. Further, the wrap spring housing 80 is fixedly secured to the spin tube 50 by a flange mount 120 that extends from the spin tube 50 and is mounted to the flange 98 of the wrap spring housing 80, such as by mechanical fasteners or a joining process, including welding. Thus, rotation of the wrap spring housing 80 induces rotation of the spin tube 50 and vice-versa.

Figure 6:
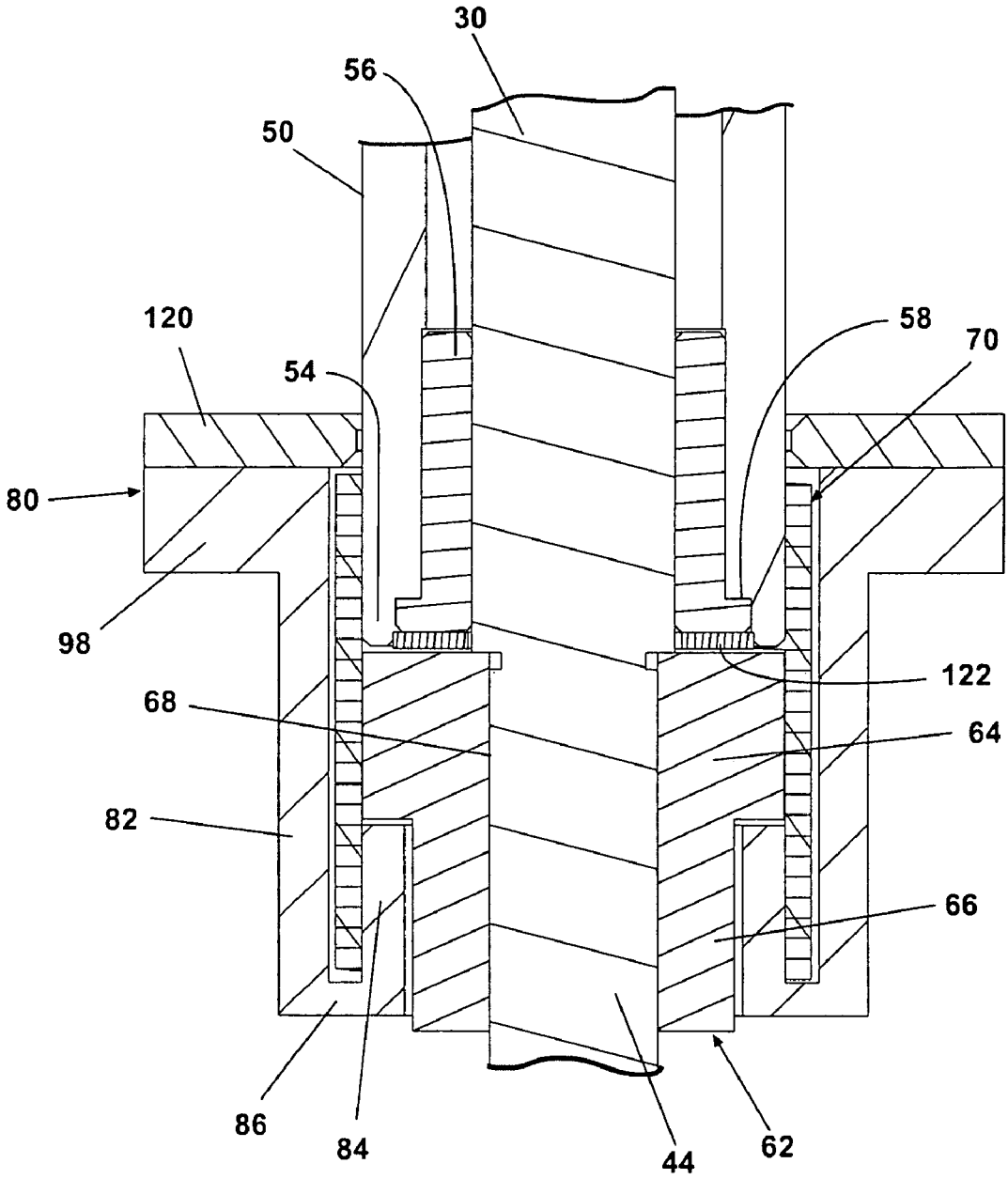
FIG. 6 is an enlarged sectional view similar to FIG. 3 and showing a portion of the clutch assembly, with the clutch assembly in the unclutched condition.

In operation, rotation of the pulley 36 by the motor 24 in a forward and/or a reverse direction rotates the agitator shaft 30 and the agitator shaft coupler 62 in the forward and reverse directions. To control transfer of rotational movement from the agitator shaft 30 to the spin tube 50, the clutch assembly 60 is operable between three clutched conditions (neutral clutched condition, first rotating clutched condition, and second rotating clutched condition) and an unclutched condition. When the clutch assembly 60 is in the neutral clutched condition shown in FIG. 3, the wrap spring 70 is in the neutral state. When in the neutral state, the wrap spring 70 is in a tightened condition, where the wrap spring 70 is tightly wound around the continuous circumferential surface to operably couple the agitator shaft 30 to the spin tube 50, as shown in FIG. 6. FIG. 6 is an enlarged view of a portion of the clutch assembly 60 to better illustrate the spatial relationship between the wrap spring 70 and the continuous circumferential surface. In the neutral clutched condition, the lower tab 74 of the wrap spring 70 is positioned near the first stop 96 of the horizontal branch 94 of the slot 90, as viewed in FIGS. 5 and 5A.

Figure 7:
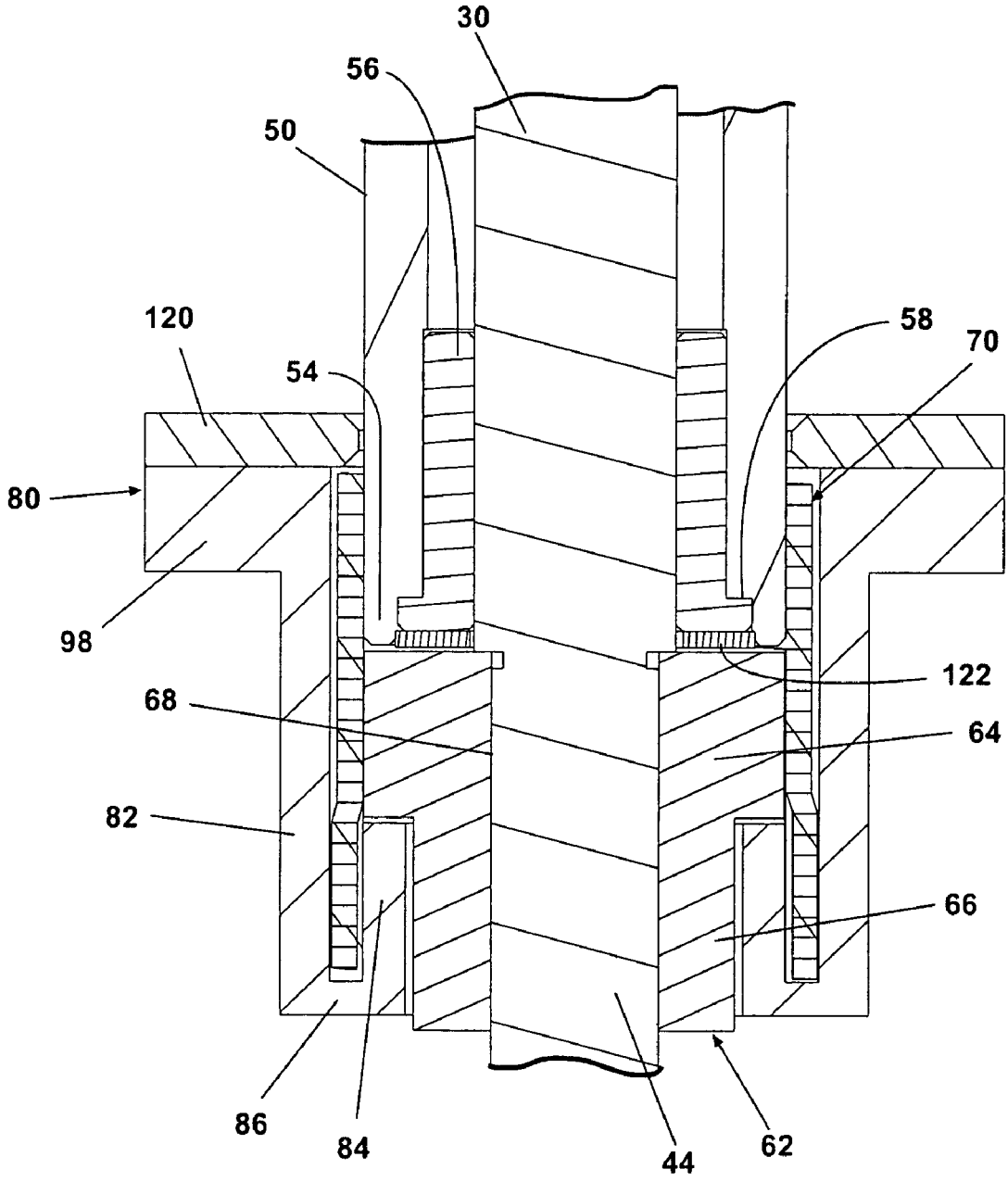
FIG. 7 is an enlarged sectional view similar to FIG. 6, with the clutch assembly in a first rotating clutched condition.

When the agitator shaft 30 rotates in a first direction, as indicated by an arrow A in FIG. 4, rotation of the agitator shaft 30 actuates the clutch assembly 60 to move to the first rotating clutched condition, and the wrap spring 70 tightens further around the upper cylindrical section 64 of the agitator shaft coupler 64 and the lower end 54 of the spin tube 50 so that rotational movement of the agitator shaft 30 and thereby the agitator shaft coupler 62 is transferred through the wrap spring 70 to the spin tube 50. Because the spin tube 50 is mounted to the wrap spring housing 80 through the flange mount 120, the wrap spring housing 80 rotates with the spin tube 50 in the first direction. During rotation of the wrap spring housing 80, the arm 124 is retracted from the cogwheel 110, which rotates with the wrap spring housing 80. The position of the lower tab 74 in the slot 90 is unchanged from its position corresponding to the neutral clutched condition of the clutch assembly 60 and remains substantially unchanged as the cogwheel 110 rotates with the wrap spring housing 80. Meanwhile, the portion of the wrap spring 70 that surrounds the inner wall 84 of the wrap spring housing 80 slips and thereby decouples the inner wall 84 from the agitator shaft coupler 62, as shown schematically in FIG. 7. FIG. 7 is similar to FIG. 6 with the wrap spring 70 schematically shown in a condition corresponding to the first rotating clutched condition of the clutch assembly 60. The purpose of this figure is to schematically illustrate that the wrap spring 70 mechanically couples the agitator shaft coupler 62 to the lower end 54 of the spin tube 50 and does not mechanically couple the agitator shaft coupler 62 to the inner wall 84 of the wrap spring housing 80. In reality, the wrap spring 70 slips around the inner wall 84 rather than forming a distinct, unchanging gap between the wrap spring 70 and the inner wall 84.

Figure 8:
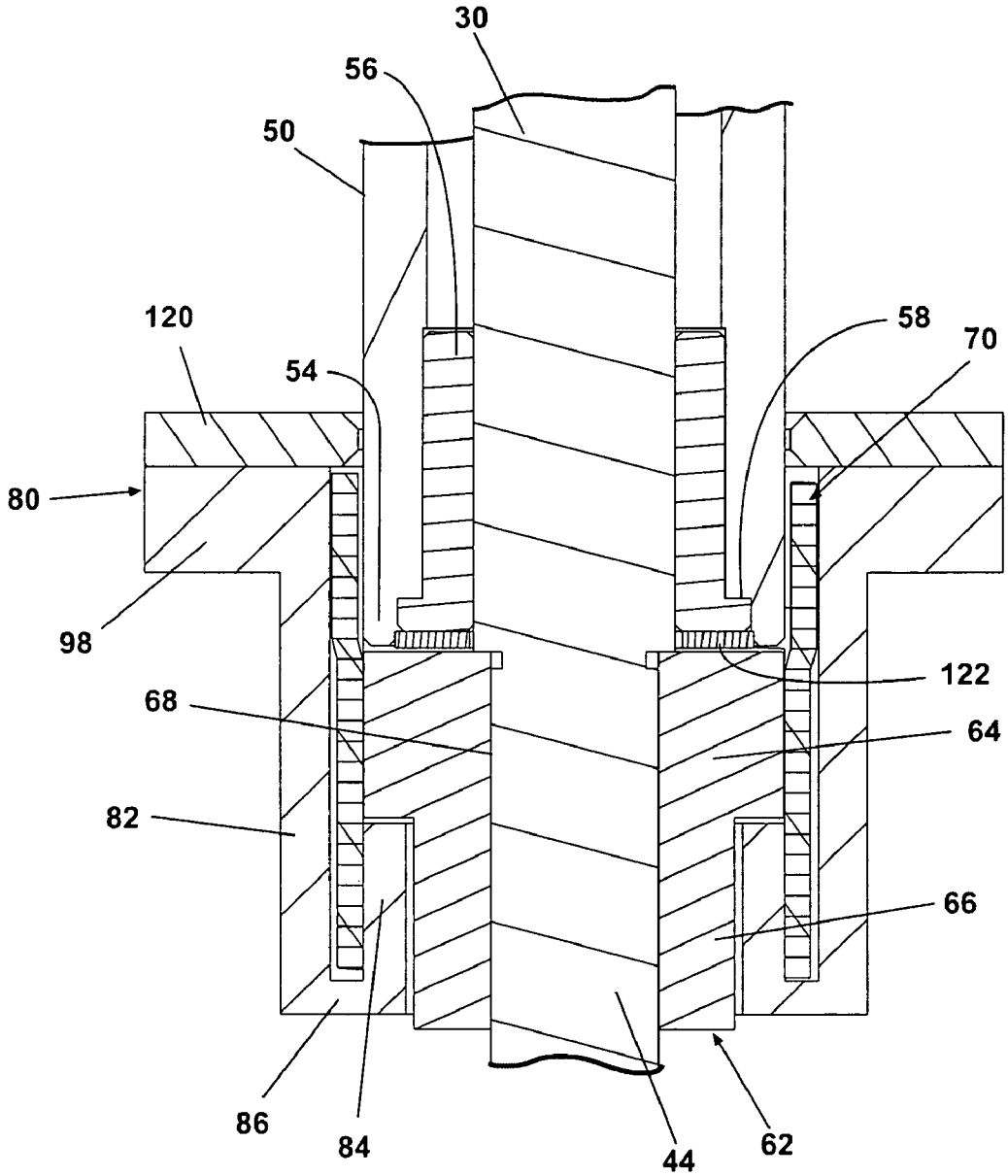
FIG. 8 is an enlarged sectional view similar to FIG. 6, with the clutch assembly in a second rotating clutched condition.

Conversely, rotation of the agitator shaft 30 in a second, opposite direction, as indicated by an arrow B in FIG. 4, actuates the clutch assembly 60 to move to the second rotating clutched condition, and the wrap spring 70 tightens further around the upper cylindrical section 64 of the agitator shaft coupler 62 and the inner wall 84 of the wrap spring housing 80 so that rotational movement of the agitator shaft 30 and thereby the agitator shaft coupler 62 is transferred through the wrap spring 70 to the wrap spring housing 80. Because the spin tube 50 is mounted to the wrap spring housing 80 through the flange mount 120, the spin tube 50 rotates with the wrap spring housing 80 in the second direction. Thus, the wrap spring 70 enables the agitator shaft 30 and the spin tube 50 to rotate together in both the first and the second directions. During rotation of the wrap spring housing 80, the arm 124 is retracted from the cogwheel 110, which rotates with the wrap spring housing 80. The position of the lower tab 74 in the slot 90 is unchanged from its position corresponding to the first rotating clutched condition of the clutch assembly 60 and remains substantially unchanged as the cogwheel 110 rotates with the wrap spring housing 80. Meanwhile, the portion of the wrap spring 70 that surrounds the lower end 54 of the spin tube 50 slips and thereby decouples the lower end 54 of the spin tube 50 from the agitator shaft coupler 62, as shown schematically in FIG. 8. FIG. 8 is similar to FIG. 7 with the wrap spring 70 schematically shown in a condition corresponding to the second rotating clutched condition of the clutch assembly 60. Similar to FIG. 7, the purpose of this figure is to schematically illustrate that the wrap spring 70 mechanically couples the agitator shaft coupler 62 to the inner wall 84 of the wrap spring housing 80 and does not mechanically couple the agitator shaft coupler 62 to the lower end 54 of the spin tube 50. In reality, the wrap spring 70 slips around the lower end 54 rather than forming a distinct, unchanging gap between the wrap spring 70 and the lower end 54.

Figure 9:
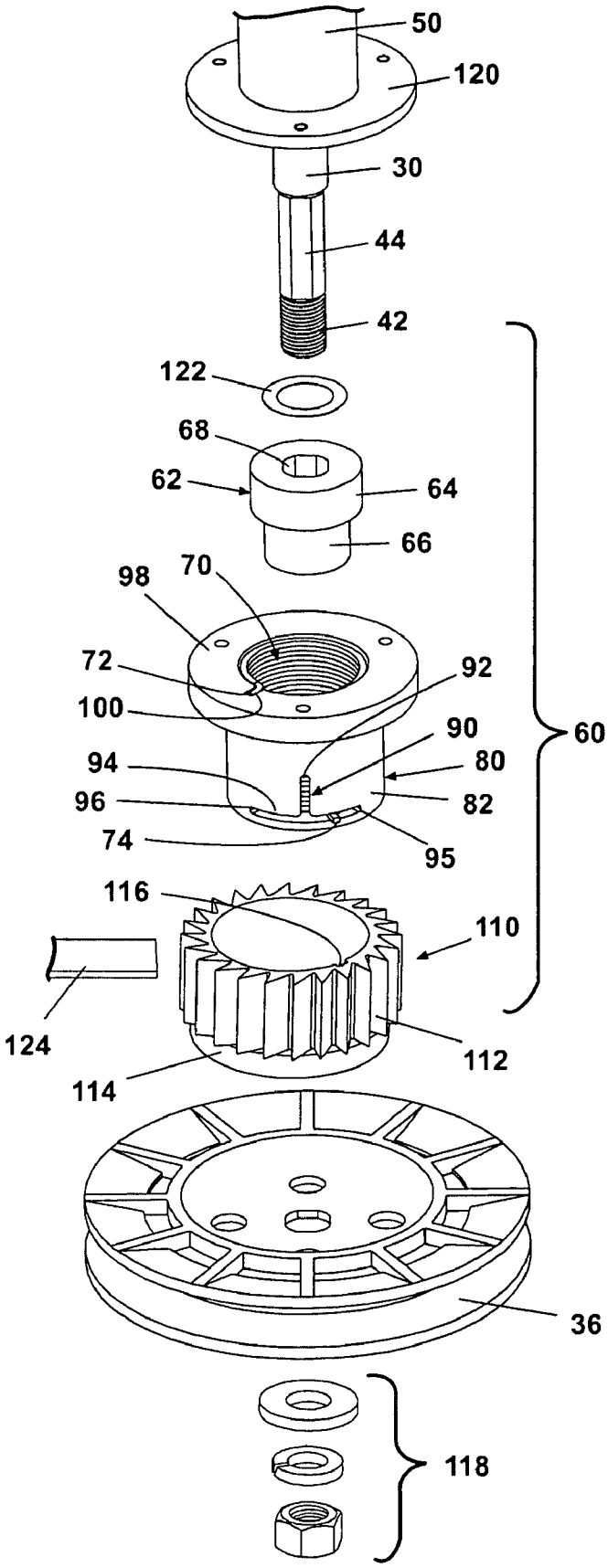
FIG. 9 is an upper exploded view similar to FIG. 2, with the clutch assembly shown in an unclutched condition.
Figure 9A:
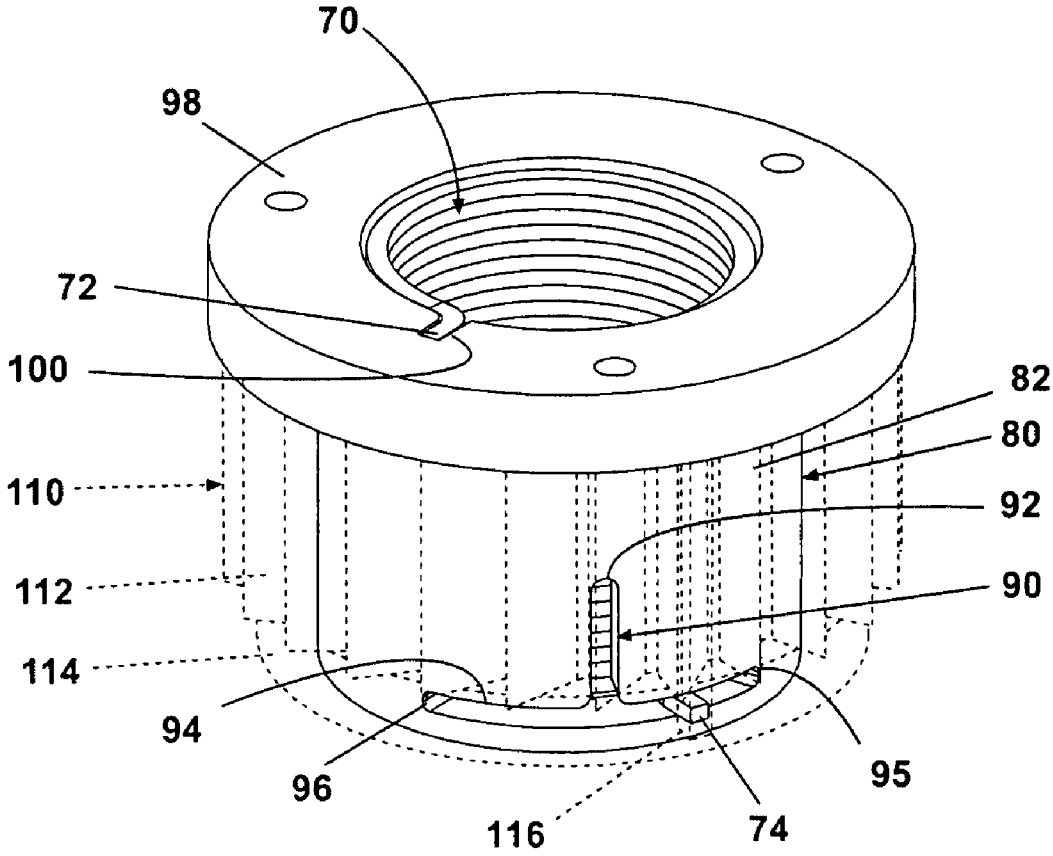
FIG. 9A is a perspective view of the wrap spring and the wrap spring housing of FIG. 9 assembled with the clutch actuator, which is shown in phantom.
Figure 10:
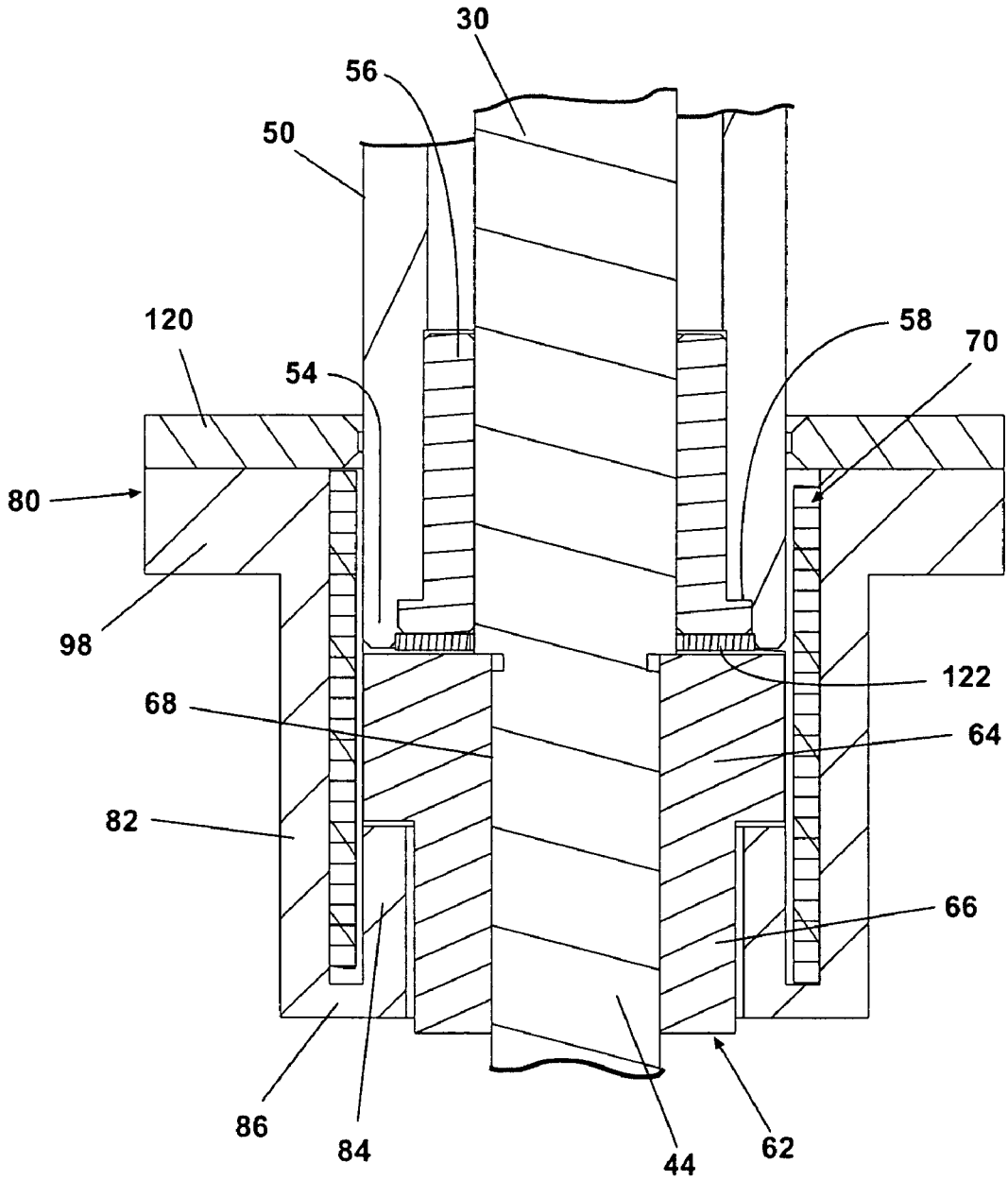
FIG. 10 is an enlarged sectional view similar to FIG. 6, with the clutch assembly in an unclutched condition.

When the clutch assembly 60 is deactivated and moved to the unclutched condition, the wrap spring 70 moves from the tightened condition (i.e., one of the tightened and neutral states) to the loosened state to decouple the agitator shaft coupler 62 from the spin tube 50 and the wrap spring housing 80; therefore, rotation of the agitator shaft 30 in either the first or second directions does not induce rotation of the spin tube 50. To move the clutch assembly 60 to the unclutched condition, the arm 124 extends toward the cogwheel 110 to engage the teeth 112, and the arm 124 displaces the cogwheel 110 in the first direction against the natural bias of the wrap spring 70 to rotate the cogwheel 110 relative to the wrap spring housing 80. Rotation of the cogwheel 110 relative to the wrap spring housing 80 in the first direction moves the lower tab 74 of the wrap spring 70 toward the second stop 95 of the horizontal branch 94 of the slot 90, as shown in FIGS. 9 and 9A, to unwind and loosen the wrap spring 70 and thereby decouple the agitator shaft coupler 62 from the spin tube 50 and the wrap spring housing 80. The position of the wrap spring 70 relative to the agitator shaft coupler 62, the spin tube 50, and the wrap spring housing 80 is schematically shown in FIG. 10. This figure schematically illustrates that the wrap spring 70 does not mechanically couple the agitator shaft coupler 62 with either the lower end 54 of the spin tube 50 or the inner wall 84 of the wrap spring housing 80 when the clutch assembly 60 is in the unclutched condition. When the arm 124 retracts from the cogwheel 110, the natural resiliency of the wrap spring 70 rotates the cogwheel 110 in the second direction to return the wrap spring 70 to the neutral clutched condition.

During operation of the washing machine 10, the controller 26 commands the motor 24 to apply torque to the agitator shaft 30 in first and second torque directions, which are torque directions that can induce rotation of the agitator shaft 30 in the first and second rotational directions, and the arm 124 to move toward and to retract from the cogwheel 110 according to the step of a selected wash cycle. During steps, such as the spin step, where the agitator 22 and the basket 18 rotate together, the arm 124 remains retracted so that the clutch assembly 60 is in one of the clutched conditions or can move between the clutched conditions described above depending on the direction of rotation induced by the motor 24. During steps, such as the wash step and the rinse step, of the wash cycle where the basket 18 must remain substantially stationary while the agitator 22 rotates in at least one of the first and second directions, the arm 124 engages the cogwheel 110 to move the clutch assembly 60 to the unclutched condition, as described above.

Because the agitator 22 and the basket 18 can be coupled together while rotating in both the first and second directions during operation of the washing machine 10, reversing the motor 24 to reverse the torque applied to the agitator shaft 30 while the clutch assembly 60 is in one of the clutched conditions acts to simultaneously slow down or brake the agitator 22 and the basket 18. Thus, simple reversal of the motor 24 dynamically brakes both the agitator 22 and the basket 18 when they are operably coupled together by the clutch assembly 60, and the need for a separate friction brake for the basket 18, as in prior art washing machines, is eliminated. Elimination of the separate friction brake and replacement by a dynamic brake formed by the clutch assembly and the motor is a major advance in drive systems for vertical axis washing machines.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic washing machine comprising:

a basket defining a wash chamber to hold a clothes load;

a spin tube coupled to the basket for cooperative rotation with the basket;

an agitator mounted for rotation within the basket;

an agitator shaft coupled to the agitator for cooperative rotation with the agitator;

a reversible motor having an output shaft coupled to the agitator shaft;

a multiple directional clutch selectively coupling the spin tube and the output shaft; and a controller operably coupled to the motor and the clutch;

wherein the motor and clutch are controlled by the controller to collectively form a dynamic brake that acts to slow down the agitator and the basket without the need of a separate friction brake by reversing direction of the motor to oppose the rotation of the basket and agitator when the spin tube and the output shaft are operably coupled together by the clutch.

2. The automatic washing machine according to claim 1, wherein the dynamic brake stops rotation of the basket regardless of a rotational direction of the basket.

3. The automatic washing machine according to claim 1, wherein the motor is operable between opposite torque directions and the motor reverses its torque direction from one of the opposite torque directions to the other of the opposite torque directions to stop the rotation of the basket.

4. The automatic washing machine according to claim 3, wherein the clutch has a clutched condition wherein the motor is coupled to the spin tube to rotate the basket.

5. The automatic washing machine according to claim 4, wherein the clutch couples the motor to the spin tube regardless of the torque direction of the motor.

6. The automatic washing machine according to claim 5, wherein the clutch comprises a wrap spring that surrounds the spin tube and is coupled to the motor.

7. The automatic washing machine according to claim 6, wherein the clutch further comprises a wrap spring housing that supports the wrap spring and is fixedly coupled to the spin tube.

8. The automatic washing machine according to claim 7, wherein the wrap spring tightly surrounds one of the spin tube and a portion or the wrap spring housing to couple the motor to the spin tube during operation of the motor in the other of the opposite torque directions to stop the rotation of the basket.

9. The automatic washing machine according to claim 8, wherein the agitator shaft couples the motor to the clutch.

10. The automatic washing machine according to claim 9, wherein the clutch further comprises an agitator coupler coupled to the agitator shaft for cooperative rotation with the agitator shaft and the wrap spring tightly surrounds the agitator shaft coupler to couple the wrap spring to the motor.

* * * * *